United States Patent [19]

Bechtold et al.

[11] 4,140,184

[45] Feb. 20, 1979

[54] METHOD FOR PRODUCING HYDROCARBONS FROM IGNEOUS SOURCES

[76] Inventors: Ira C. Bechtold, 1987 Skyline Vista Dr., La Habra, Calif. 90631; H. Randall Emmerson, 47 Rockview Dr., Irvine, Calif. 92715

[21] Appl. No.: 741,794

[22] Filed: Nov. 15, 1976

[51] Int. Cl.[2] ..... C01B 1/08; C10J 5/00; E21B 43/24; E21B 43/26

[52] U.S. Cl. ..... 166/300; 48/197 R; 48/DIG. 7; 166/266; 166/270; 166/271

[58] Field of Search ..... 48/DIG. 6, DIG. 7, 89, 48/98, 99, 197 R, 209; 165/45; 166/300, 271, 302, 305 R, 272, 270

[56] References Cited

U.S. PATENT DOCUMENTS

| | | | |
|---|---|---|---|
| 2,761,824 | 9/1956 | Eastman et al. | 48/DIG. 7 |
| 3,449,247 | 6/1969 | Bauer | 166/300 X |
| 3,794,116 | 2/1974 | Higgins | 48/DIG. 6 X |
| 3,858,397 | 1/1975 | Jacoby | 165/45 X |
| 3,967,675 | 7/1976 | Georgii | 165/45 X |
| 4,078,904 | 3/1978 | Galt et al. | 48/197 R |

FOREIGN PATENT DOCUMENTS

| | | | |
|---|---|---|---|
| 168,581 | 1/1922 | United Kingdom | 48/DIG. 7 |

OTHER PUBLICATIONS

Oil & Gas Journal, "Igneous Rocks Seen Promising for Gas", Apr. 5, 1971, p. 33.

Weismann, "Stable Carbon Isotope Investigation of Natural Gases from Sacramento & Delaware-Val Verde Basins-Possible Igneous Origin", (Abs.) Bulletin, AAPG, vol. 55, No. 2, p. 369.

*Primary Examiner*—Stephen J. Novosad

*Attorney, Agent, or Firm*—William W. Haefliger

[57] ABSTRACT

A method of producing a hydrocarbon or hydrocarbons is disclosed. The method employs carbon containing material, water and a reaction chamber in a hot subterranean formation. The method steps include:

(a) forming an aqueous slurry containing said material in divided, flowable form, (b) passing the slurry into said subterranean formation for chemical interaction of said material at said elevated temperature to form said hydrocarbon, and (c) recovering said hydrocarbon.

15 Claims, 1 Drawing Figure

METHOD FOR PRODUCING HYDROCARBONS FROM IGNEOUS SOURCES

BACKGROUND OF THE INVENTION

This invention relates generally to processes for production of hydrocarbons and other useful products from carbon bearing sources, and employing subterranean heating for effecting process reactions.

It is known that there is a possible natural source of hydrocarbons from carbon bearing sources, which is believed to be accomplished by the intrusion of carbon bearing rocks by hot magmas or molten rocks. See for example, "Inorganic Origin of Petroleum" V. B. Porfir-'ev, in "The American Association of Petroleum Geologists Bulletin": vol. 58, No. 1, page 3 (January 1974). It is also believed that these hot magmas in altering other rocks such as granites, diorites, monzonites, andosites, rhyolites and others containing feldspars, produce, by well known alteration reactions, clays, which serve as catalysts for the formation of the hydrocarbons. Metallic compounds, which enhance such catalysis, are also present. See for example "Igneous Rocks Seen Promising for Gas": Oil & Gas Jour., Apr. 5, 1971, p. 33; Weismann, T. M. 1971; "Stable Carbon Isotope Investigation of Natural Gases from Sacramento and Delaware-Val Verde Basins—Possible Igneous Origin" (Abs.): Bull, AAPG, V.55, N.2, p. 369.1.

Water present naturally as liquid or vapor in the rocks decomposes into hydrogen, joining with carbon and carbon compounds to produce methane, ethane or propane, and other hydrocarbons etc., and possibly some unsaturated hydrocarbons such as ethylene and polylene. Thus, liquid hydrocarbons can be formed.

SUMMARY OF THE INVENTION

It is a major object of the present invention to provide a method for employing subterranean heat to effect hydrocarbon production from carbon containing material and water. As will be seen, the method basically involves the use or provision of a reaction chamber in a subterranean formation and includes the steps:

(a) forming an aqueous slurry containing said material in divided, flowable form, (b) passing the slurry into the subterranean chamber for decomposition of the material and reaction with water to form the hydrocarbon, and (c) recovering the hydrocarbon.

Typically, a subterranean magmatic source of heat is utilized to provide heat transfer to slurry in the chamber located proximate the source; a down-passage or well is formed to extend from the surface to the chamber, for passing the slurry to the chamber; and the slurry typically includes both the carbon containing material and a catalyst clay with additives of metallic compounds or other accelerators in ground or comminuted form mixed with water. The catalyst clay and additives of metallic compounds other accelerators may be provided by the natural reactions of the minerals of the magmatic source with surrounding rocks in which case they may not be required in the slurry. However, the carbon containing material and/or catalyst may be supplied in dry form to the down-passage, and water added later. In this regard, the carbon containing material is typically selected from the group which consists of magnesium carbonate, calcium carbonate, with lignite, oil shale, tar sand, gilsonite, limestone and coal, and limestone and graphite, or mixtures of these such materials being representative.

In the hot subterranean chamber, the combination of the carbon with hydrogen produces hydrocarbons and by utilizing available temperatures for a long enough period of time reactions may occur, to form polymers hence liquid hydrocarbons. Also it is possible to form unsaturated hydrocarbons such as those containing ethylene, propylene and acetylene. The catalyst in the slurry assures the presence of the catalyst which might not have been formed by the contact of the hot rocks with the surrounding rocks from which alteration clays are produced in the natural process. When the gases are formed they must be collected and taken out through another well.

It is desirable in order to make as much surface as possible, to fracture the formation well below its entry into the hot zone so that it will provide a large amount of surface and access through the cracks where the carbon containing material contacts the heat source. Also the zone may be located within a region where gases from the contact of the heat source by the carbon containing rocks will travel "up dip" or through fracture zones in the geologic structure of the region. The zone is so selected that strata or contact areas between different kinds of rocks of different age are sloping upward or fractured so that the gases may travel through these strata or the spaces between them and collect away from the point of formation in porous rocks of the same kind as are present in natural gas reservoirs. Then a second well is typically drilled into the stratified rocks or the contact zone between two different rocks of different ages where the collected gas can be drawn off through the second well and collected, put into a pipeline and carried away for use in the gas system. The second well is preferably located in the vicinity of porous areas or areas with cavities present. Should the zone of collection be located at some distance from the point of origin of the gas there is a large amount of time available for the gases to react on their way to the collection zone.

These and other objects and advantages of the invention, as well as the details of an illustrative embodiment, will be more fully understood from the following description and drawings, in which:

DRAWING DESCRIPTION

FIG. 1 is a vertical section through the earth and illustrating the process.

DETAILED DESCRIPTION

Figure 1:
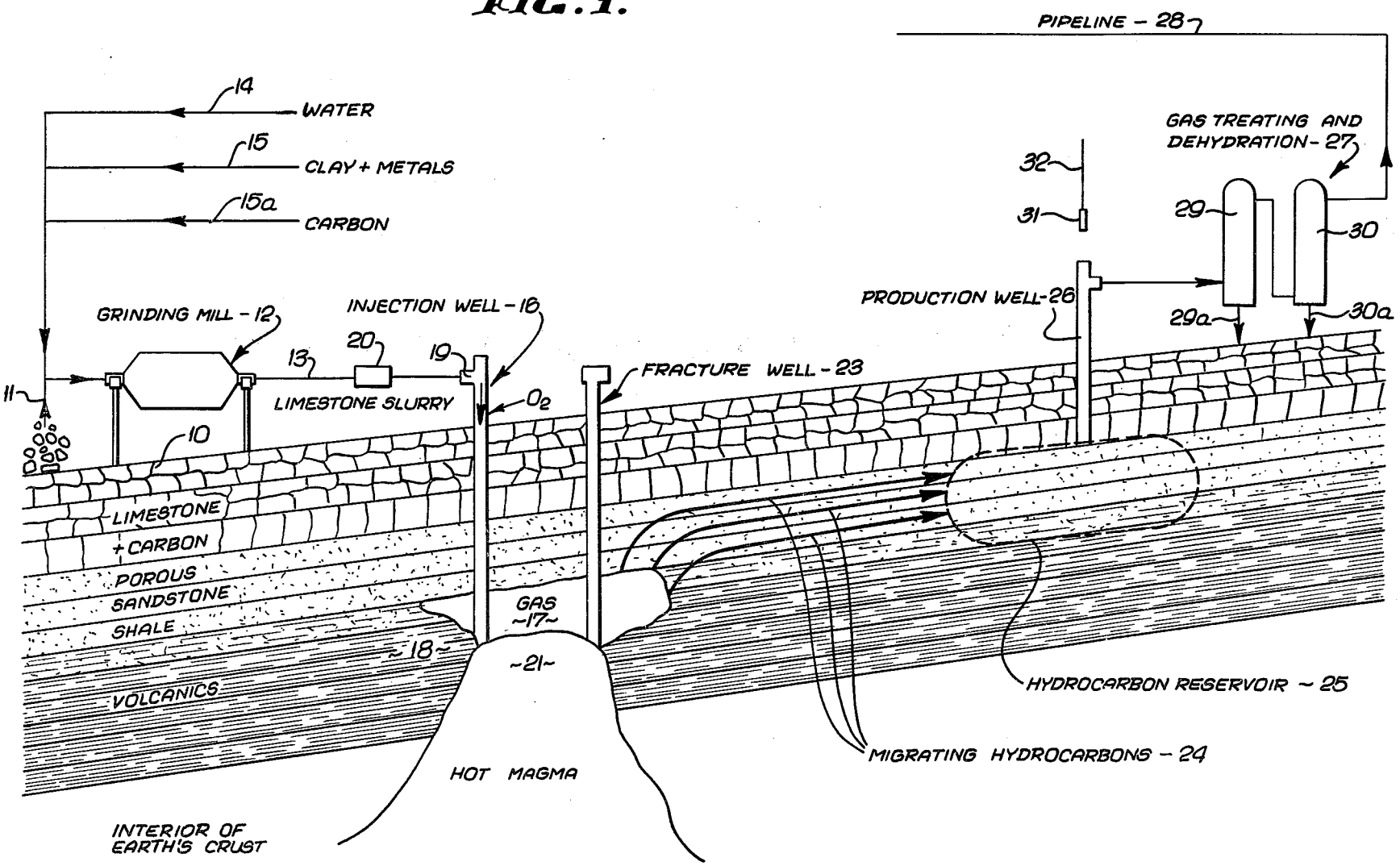

The invention basically involves an unusually advantageous method for employing magmatic or subterranean heat to effect the interaction of carbon and carbon oxides with water or other source of hydrogen supplied to a subterranean chamber, to form a hydrocarbon or hydrocarbons.

Referring to FIG. 1, a carbon containing material is obtained or delivered from a source, as for example the limestone layer or bed 10 with or without other carbon containing materials. In general, the bed may consist of calcium and/or magnesium carbonate; with, other usable carbon containing materials including lignite, oil shale, tar sand, gilsonite, and graphite or coal which may or may not lie in intimately bonded or in adherent combination with rock.

The feed may typically be delivered as at 11 to a mill or crusher 12 producing a comminuted feed stream at 13. Water, metallic compounds, clay, and carbon may also be delivered to the mill at 14, 15 and 15*a* whereby the feed stream 13 may consist of slurry of carbon containing material and clay and metallic compounds, these being in the correct proportion to act as a catalyst, as will be described.

An injection well or down passage 16 is formed in the earth to communicate between the surface and a subterranean chamber 17 located in a hot formation 18. The slurry is introduced into the upper head end of the well at 19, and passes downwardly to chamber 17. If necessary, the slurry may be pumped into the well head, as via pump 20. The well may be cased and the well head may be enclosed, as shown, to contain pressure which can enhance the desired reactions and provide for additional forces to extend fracturing.

Slurry in chamber 17 is heated to elevated temperature, to undergo hydrocarbon forming reactions.

Subterranean heat is transferred to the chamber 17 typically as from a hot magma source 21 near which the chamber 17 may be formed. In this regard, the chamber 17 may comprise the lower end of the well 16 drilled into the earth into proximity to the hot magma. The latter may be either molten or solid, so long as the required heating of the slurry is realized.

The produced $CO_2$ reacts with carbon and $H_2O$ in the chamber typically to form hydrogen and ultimately hydrocarbons. The catalyst clay may, for example, be selected from the group consisting of montmorillonite, kaolinite and illite. The metallic compounds may be supplied by iron or other heavy metal oxides or combinations of same or other compounds having catalytic activity. By utilizing available heat and temperatures for a sufficient time, reactions may occur, and form polymers, hence liquid hydrocarbons. Also it is possible in this way to form unsaturated hydrocarbons such as those containing ethylene, propylene and acetylene. Carbon containing materials such as lignite, oil shale, tar sand, and gilsonite, may enhance production.

It is desirable to fracture the formation 18 proximate the lower end of the injection well, i.e. at and near chamber 17, so as to provide a large amount of surface and access through the cracks whereby slurry contacts the heat source. If it is not desired to utilize well 16 as a fracture well for this purpose, a fracture well 23 may be drilled downwardly near the injection well, and various fracturing techniques well known in petroleum production may be carried out.

Also, the chamber 17 may advantageously be located proximate an upwardly sloping subterranean stratified rock formation. As a result, the produced hydrocarbons will travel "up dip" or through fractures in the geologic structure of the region, as is clear from FIG. 1. Flow arrows 24 indicate such migration or travel through strata, or spaces between them, for collection at a porous rock zone 25 spaced at some distance from the chamber 17. As a result, time is available for the gases to polymerize or otherwise react.

Recovery of the hydrocarbon gases typically includes the step of providing an up-passage extending from the porous rock formation 25 to the earth's surface, for passing the gases to the surface, typically a well 26. The gas flowing upwardly in passage 26 is collected and passed through a dehydration and treating station 27, and then fed to a pipeline 28. Heavier hydrocarbons may be withdrawn from the treating vessels 29 and 30 at 29*a* and 30*a*. Liquid hydrocarbons in zone 25 may be upwardly removed as by pumping, if necessary. For this purpose, a pump is shown at 31 suspended by tubing 32, to be lowered into well 26.

At the injection well 16 other components may be inserted, such as oxygen, nitrogen, ammonia, or other reactants which with the hydrocarbons will react to form compounds other than hydrocarbons, such as alcohols, ketones, esters, amines, etc.

We claim:

1. In the method of producing a hydrocarbon and employing carbon containing material, water and a reaction chamber in a hot subterranean formation, the steps that include:

(a) forming an aqueous slurry containing said material in divided, flowable form, said carbon containing material consisting of a mineral carbonate, (b) passing the slurry into said subterranean formation for chemical interaction of said material and water at elevated temperature to form said hydrocarbon, and (c) recovering said hydrocarbon, (d) said method including the preliminary step of locating the chamber in said hot subterranean formation for receiving said slurry, a subterranean magmatic source of heat being utilized, and wherein said locating step is carried out to locate the chamber in heat transfer proximity with said subterranean magmatic source of heat.

2. The method of claim 1 wherein said locating step is carried out to locate said chamber proximate a subterranean porous rock formation in which said hydrocarbon tends to collect in fluid state, and said recovering step includes providing an up-passage extending from said porous rock formation to the earth surface for passing said hydrocarbon to the surface.

3. The method of claim 1 wherein said mineral carbonate is selected from the group consisting of calcium carbonate and magnesium carbonate.

4. The method of claim 1 including the step of introducing into said chamber components selected from the group consisting of oxygen, nitrogen, ammonia and other oxygen and nitrogen containing reactants which will react with the hydrocarbon to form compounds containing hydrogen, carbon, oxygen and nitrogen.

5. In the method of producing a hydrocarbon and employing a carbon containing material, water and a reaction chamber in a hot subterranean formation, the steps that include, (a) forming an aqueous slurry containing said material in divided, flowable form, (b) passing the slurry into said subterranean formation for chemical interaction of said material and water at elevated temperature to form said hydrocarbon, and introducing a catalyst into said chamber for catalyzing the interaction to form the hydrocarbon, and (c) recovering said hydrocarbon, said method including the preliminary step of locating the chamber in said hot subterranean formation for receiving said slurry and catalyst, a subterranean magmatic source of heat being utilized, and wherein said locating step is carried out to locate the chamber proximate said subterranean magmatic source of heat to provide heat transfer from the magmatic source to the slurry in the chamber, the carbon containing material selected from the group which includes magnesium carbonate, calcium carbonate, lignite, oil shale, tar sand, gilsonite, limestone and coal, and limestone and graphite, and mixtures thereof.

6. The method of claim 5 including the step of forming a down-passage extending between the earth surface and said subterranean chamber, said passing step including passing the slurry via said down passage to said chamber.

7. The method of claim 6 that includes the step of fracturing the formation proximate said passage and said chamber.

8. The method of claim 5 wherein said catalyst consists of a clay.

9. The method of claim 8 wherein said clay is selected from the group which consists of montmorillonite, kaolinite, and illite.

10. The method of claim 8 wherein said clay is selected from the group which consists of iron and other heavy metal compounds.

11. The method of claim 5 wherein said introducing step includes including said catalyst in the slurry being passed to said chamber.

12. The method of claim 11 including the preliminary step of grinding the carbon containing material and the clay for mixing with water to form the slurry.

13. In the method of producing a hydrocarbon and employing carbon containing material, water and a reaction chamber in a hot subterranean formation, the steps that include:

(a) forming an aqueous slurry containing said material in divided, flowable form, (b) passing the slurry into said subterranean formation for chemical interaction of said material and water at elevated temperature to form said hydrocabon, and (c) recovering said hydrocarbon, (d) said method including the preliminary step of locating the chamber in said hot subterranean formation for receiving said slurry, a subterranean magmatic source of heat being utilized, and wherein said locating step is carried out to locate the chamber proximate an upwardly sloping subterranean stratified rock formation and in heat transfer proximity with said subterranean magmatic source of heat.

14. In the method of producing a hydrocarbon and employing carbon containing material, water and a reaction chamber in a hot subterranean formation, the steps that include:

(a) forming an aqueous slurry containing said material in divided, flowable form, (b) passing the slurry into said subterranean formation for chemical interaction of said material and water at elevated temperature to form said hydrocarbon, and introducing a catalyst into said chamber for catalyzing the interaction to form the hydrocarbon, and (c) recovering said hydrocarbon, (d) said method including the preliminary step of locating the chamber in said hot subterranean formation for receiving said slurry, a subterranean magmatic source of heat being utilized, and wherein said locating step is carried out to locate the chamber in heat transfer proximity with said subterranean magmatic source of heat.

15. The method of claim 14 wherein said carbon containing material is selected from the group consisting of magnesium carbonate, calcium carbonate, together with lignite, oil shale, tar sand, gilsonite, limestone and coal, and limestone and graphite.

* * * * *